US010984694B2

(12) United States Patent
Lin et al.

(10) Patent No.: US 10,984,694 B2
(45) Date of Patent: Apr. 20, 2021

(54) DISPLAY DEVICE AND MULTIPLEXER CIRCUIT THEREOF

(71) Applicant: AU Optronics Corporation, Hsin-Chu (TW)

(72) Inventors: Rong-Fu Lin, Hsin-Chu (TW); Chi Yu, Hsin-Chu (TW); Chih-Fu Yang, Hsin-Chu (TW); Jie-Chuan Huang, Hsin-Chu (TW); Sung-Yu Su, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 14 days.

(21) Appl. No.: 16/364,254

(22) Filed: Mar. 26, 2019

(65) Prior Publication Data

US 2020/0312207 A1 Oct. 1, 2020

(51) Int. Cl.
*G09G 3/20* (2006.01)

(52) U.S. Cl.
CPC ..... *G09G 3/20* (2013.01); *G09G 2310/0297* (2013.01); *G09G 2310/06* (2013.01)

(58) Field of Classification Search
CPC .... G06F 3/04883; G06F 3/04845; G06F 3/20; G06K 9/222
See application file for complete search history.

(56) References Cited

U.S. PATENT DOCUMENTS

2009/0002280 A1 1/2009 Kim et al.
2009/0195492 A1* 8/2009 Takahashi ..... G09G 3/3688 345/98
2009/0207104 A1* 8/2009 Lee ..... G09G 3/3275 345/76
2013/0141320 A1* 6/2013 Kim ..... G09G 3/3688 345/92
2015/0213753 A1* 7/2015 Lin ..... G09G 3/2096 345/214
2016/0078845 A1* 3/2016 Lin ..... G09G 3/20 345/213

FOREIGN PATENT DOCUMENTS

CN 205608693 U 9/2016
CN 106292096 A 1/2017

* cited by examiner

*Primary Examiner* — Mark Edwards
(74) *Attorney, Agent, or Firm* — WPAT, PC

(57) ABSTRACT

A multiplexer circuit includes a first switch unit and a second switch unit. The first switch unit is electrically connected to a first data line and a first pixel circuit, and configured to turn on according to a first signal in a first time duration. The second switch unit is electrically connected to the first data line and a second pixel circuit, and configured to turn on according to a second signal in a second time duration. The first time duration and the second time duration substantially start or end at a same time, so that the first time duration and the second time duration have overlap.

2 Claims, 9 Drawing Sheets

DISPLAY DEVICE AND MULTIPLEXER CIRCUIT THEREOF

BACKGROUND

Technical Field

The present disclosure relates to a display device and a multiplexer circuit, and more particularly to a circuit that configured to receive a data voltage from a data line to drive a pixel circuit.

Description of Related Art

The flat panel display is one of the most popular display devices because of its high quality image display performance and low power consumption. Considering the cost of production, the display panel of the display device has a multiplexer and a corresponding control circuit for transmitting the driving signal. Accordingly, the number of transmission pins on a control chip and the volume of the control chip can be reduced.

Generally, the pixels in the display panel are driven by the polarity inversion voltage. After receiving the data voltage, the multiplexer sequentially charges each pixel so as to drive the pixel illumination. Therefore, the multiplexer and control circuit have the most direct impact on the display quality of the display panel.

SUMMARY

One aspect of the present disclosure is a multiplexer circuit. The multiplexer circuit includes a first switch unit and a second switch unit. The first switch unit is electrically connected to a first data line and a first pixel circuit, and configured to turn on according to a first signal in a first time duration. The second switch unit is electrically connected to the first data line and a second pixel circuit, and configured to turn on according to a second signal in a second time duration. The first time duration and the second time duration substantially start or end at a same time, so that the first time duration and the second time duration have overlap.

Another aspect of the present disclosure is a display device. The display device comprises a plurality of pixel circuits, a first data line and a multiplexer circuit. The first data line is configured to transmit a first data voltage. The multiplexer circuit is configured to receive the first data voltage The multiplexer circuit is configured to transmit the first data voltage to the plurality of pixel circuits according to a first signal in a first time duration, and transmit the second data voltage to the plurality of pixel circuits according to a second signal in a second time duration. The first time duration and the second time duration substantially start or end at a same time, so that the first time duration and the second time duration have overlap.

It is to be understood that both the foregoing general description and the following detailed description are by examples, and are intended to provide further explanation of the disclosure as claimed.

BRIEF DESCRIPTION OF THE DRAWINGS

The present disclosure can be more fully understood by reading the following detailed description of the embodiment, with reference made to the accompanying drawings as follows.

DETAILED DESCRIPTION

For the embodiment below is described in detail with the accompanying drawings, embodiments are not provided to limit the scope of the present disclosure. Moreover, the operation of the described structure is not for limiting the order of implementation. Any device with equivalent functions that is produced from a structure formed by a recombination of elements is all covered by the scope of the present disclosure. Drawings are for the purpose of illustration only, and not plotted in accordance with the original size.

It will be understood that when an element is referred to as being "connected to" or "coupled to", it can be directly connected or coupled to the other element or intervening elements may be present. In contrast, when an element to another element is referred to as being "directly connected" or "directly coupled," there are no intervening elements present. As used herein, the term "and/or" includes an associated listed items or any and all combinations of more.

Figure 1:
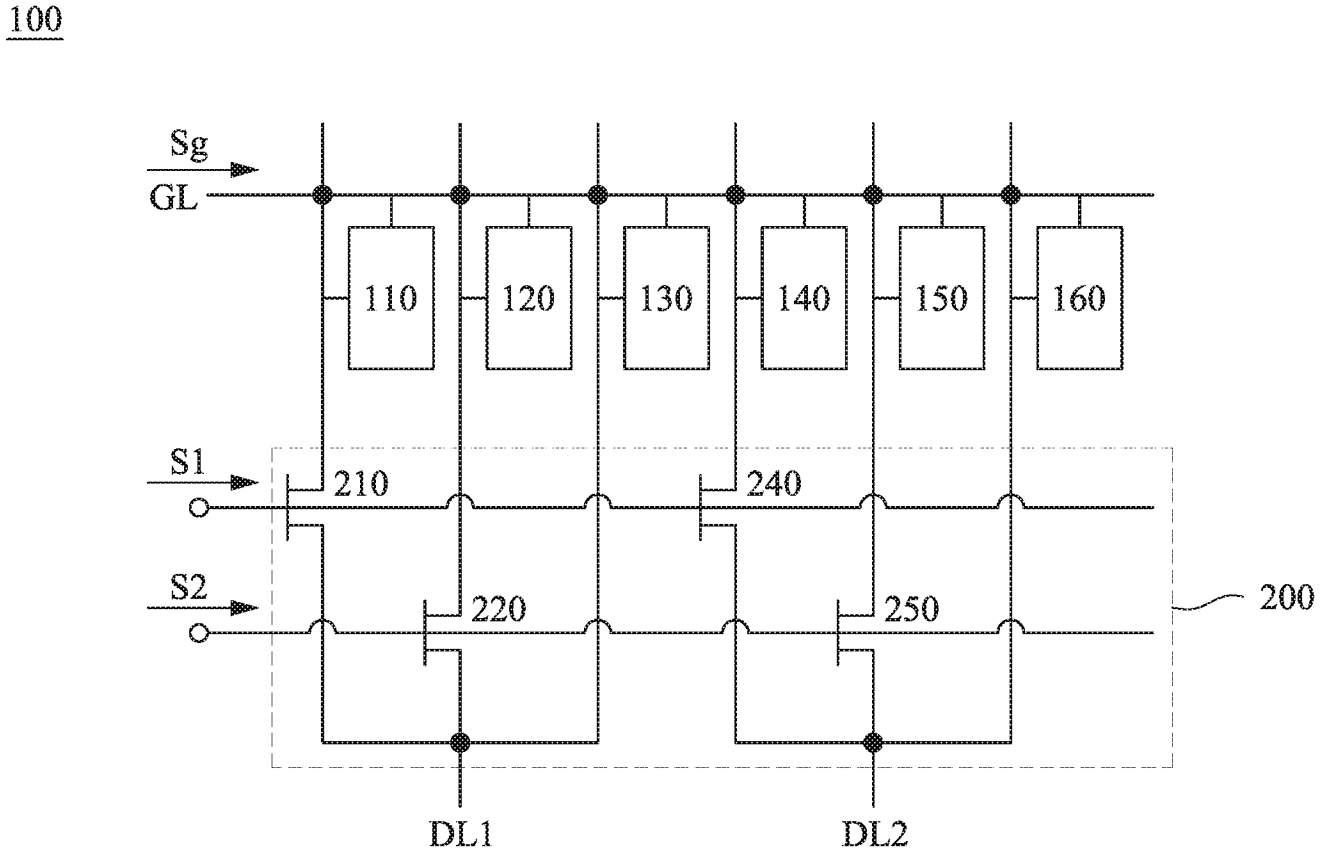
FIG. 1 is a schematic diagram of a display device in some embodiments of the present disclosure.
Figure 2:
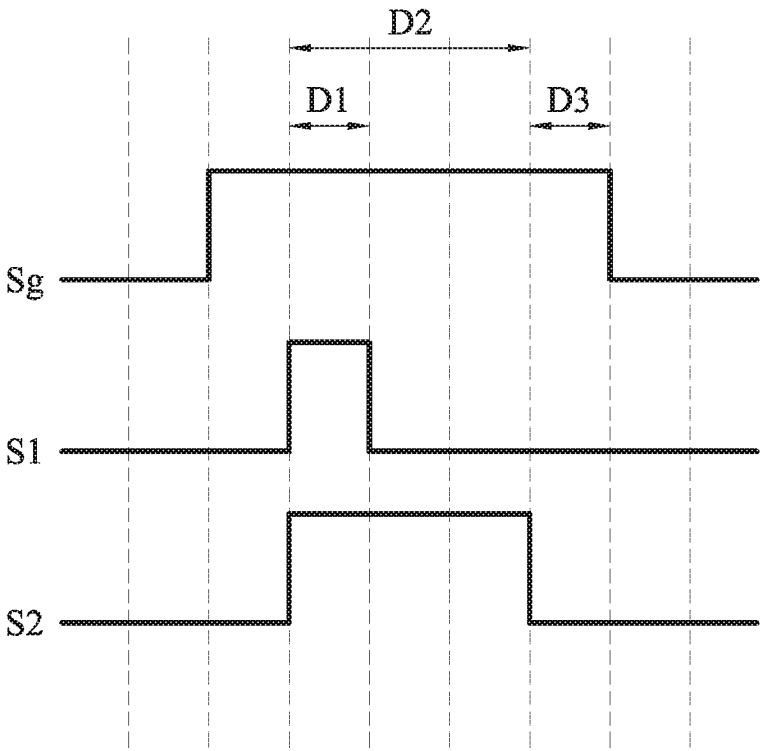
FIG. 2 is a waveform diagram of a display device in some embodiments of the present disclosure.

Referring to FIG. 1 and FIG. 2. FIG. 1 is a schematic diagram of a display device 100 and a multiplexer circuit 200 in some embodiments of the present disclosure. FIG. 2 is a waveform diagram of a multiplexer circuit 200 in some embodiments of the present disclosure. In some embodiments, the display device 100 includes multiple pixel circuits 110-160, multiple data lines (e.g., a first data line DL1 and a second data line DL2 shown in FIG. 1) and the multiplexer circuit 200. The data lines are configured to transmit multiple data voltage from a processor. For example, the first data line DL1 is configured to transmit a first data voltage, and the second data line DL2 is configured to transmit a second data voltage. Details will be described in subsequent paragraphs.

The first pixel circuit 110, the second pixel circuit 120 and the third pixel circuit 130 are drived by data voltage of the first data line DL1, and respectively display multiple sub-pixels of one pixel. For example, the first pixel circuit 110 is configured to display the red light the second pixel circuit 120 is configured to display the green light the third pixel circuit 130 is configured to display the blue light. Similarly, the fourth pixel circuit 140, the fifth pixel circuit 150 and the sixth pixel circuit 160 is drived by a second data line DL2, and respectively display multiple sub-pixels of another pixel.

The multiplexer circuit 200 is configured to receive data voltage from the data lines, then respectively transmits data voltage to pixel circuits 110-160. The multiplexer circuit 200 includes a first switch unit 210 and a second switch unit 220. The first switch unit 210 is electrically connected to the first data line DL1 and the first pixel circuit 110, and configured to turn on according to a first signal S1 in a first time duration D1. In some embodiments, the first terminal of the first switch unit 210 is connected to the first pixel circuit 110, and the second terminal of the first switch unit 210 is connected to the first data line DL1. The control terminal of the first switch unit 210 is configured to receive the first signal S1 so as to control the first switch unit 210 to turn on or turn off.

The second switch unit 220 is electrically connected to the first data line DL1 and the second pixel circuit 120, and configured to turn on according to a second signal S2 in a second time duration D2. The first terminal of second switch unit 220 is connected to the second pixel circuit 120, and the second terminal of the second switch unit 220 is connected to the first data line DL1. The control terminal of the first switch unit 210 is configured to receive the second signal S2 so as to control the second switch unit 220 to turn on or turn off.

The first time duration D1 and the second time duration D2 substantially start or end at a same time, so that the first time duration D1 and the second time duration D2 have overlap. As shown in FIG. 2, the starting point of the first time duration D1 is the same as the starting point of the second time duration D2, but the end time point of the first time duration D1 is different from the end point of the second time duration D2.

Figure 3A:
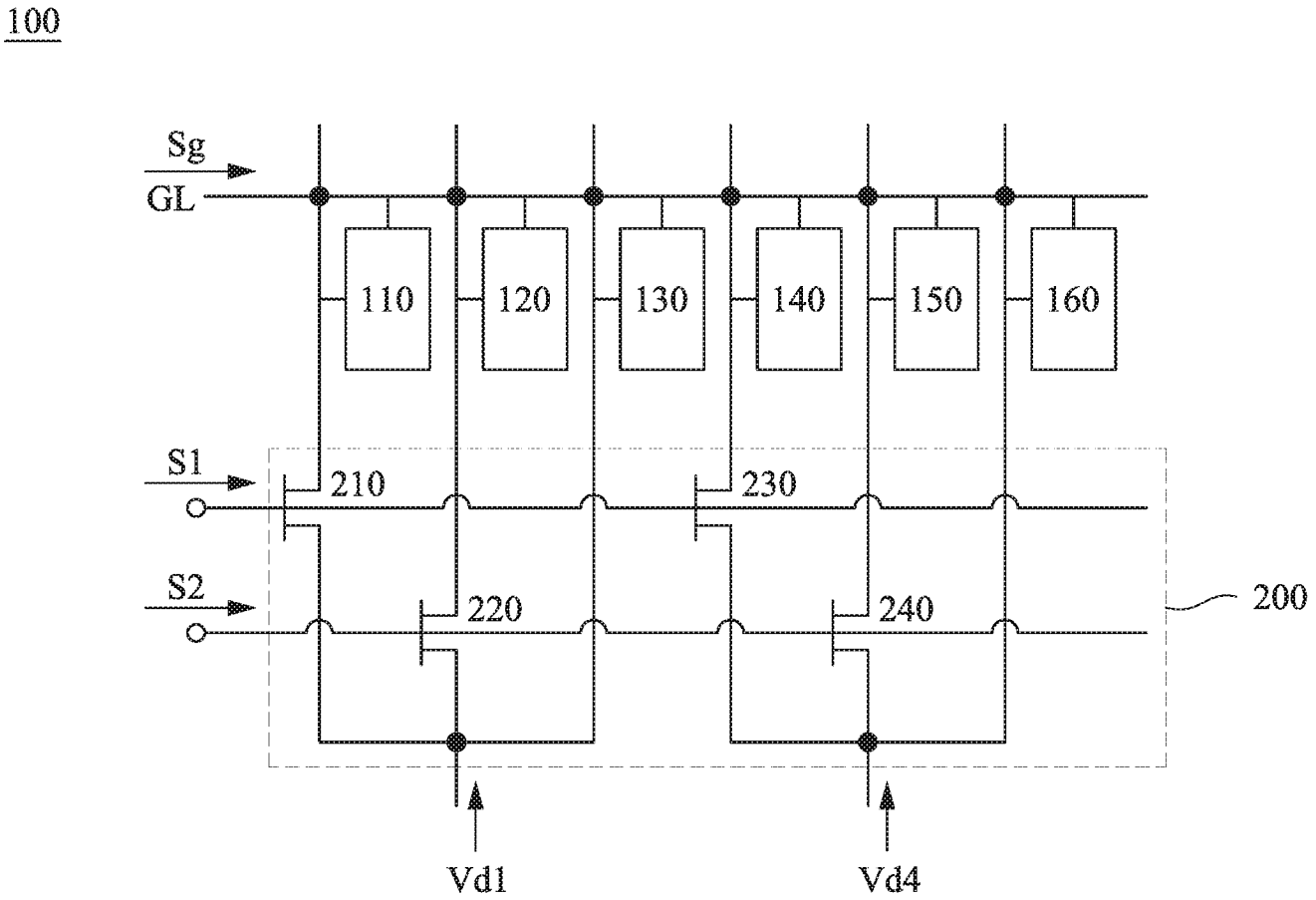
FIG. 3A-3C are schematic diagrams of operational status of the multiplexer circuit in some embodiments of the present disclosure.
Figure 3B:
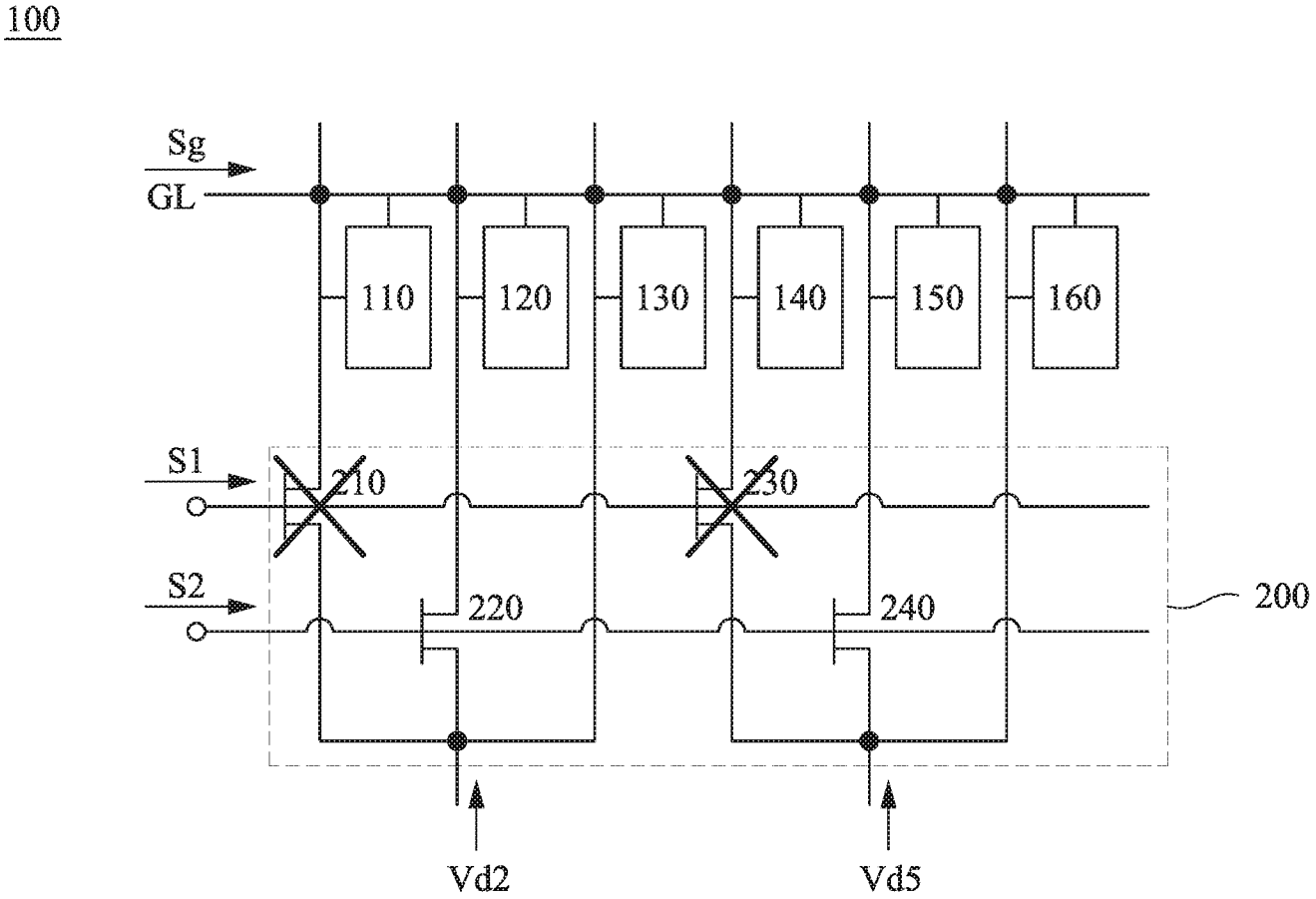
Figure 3C:
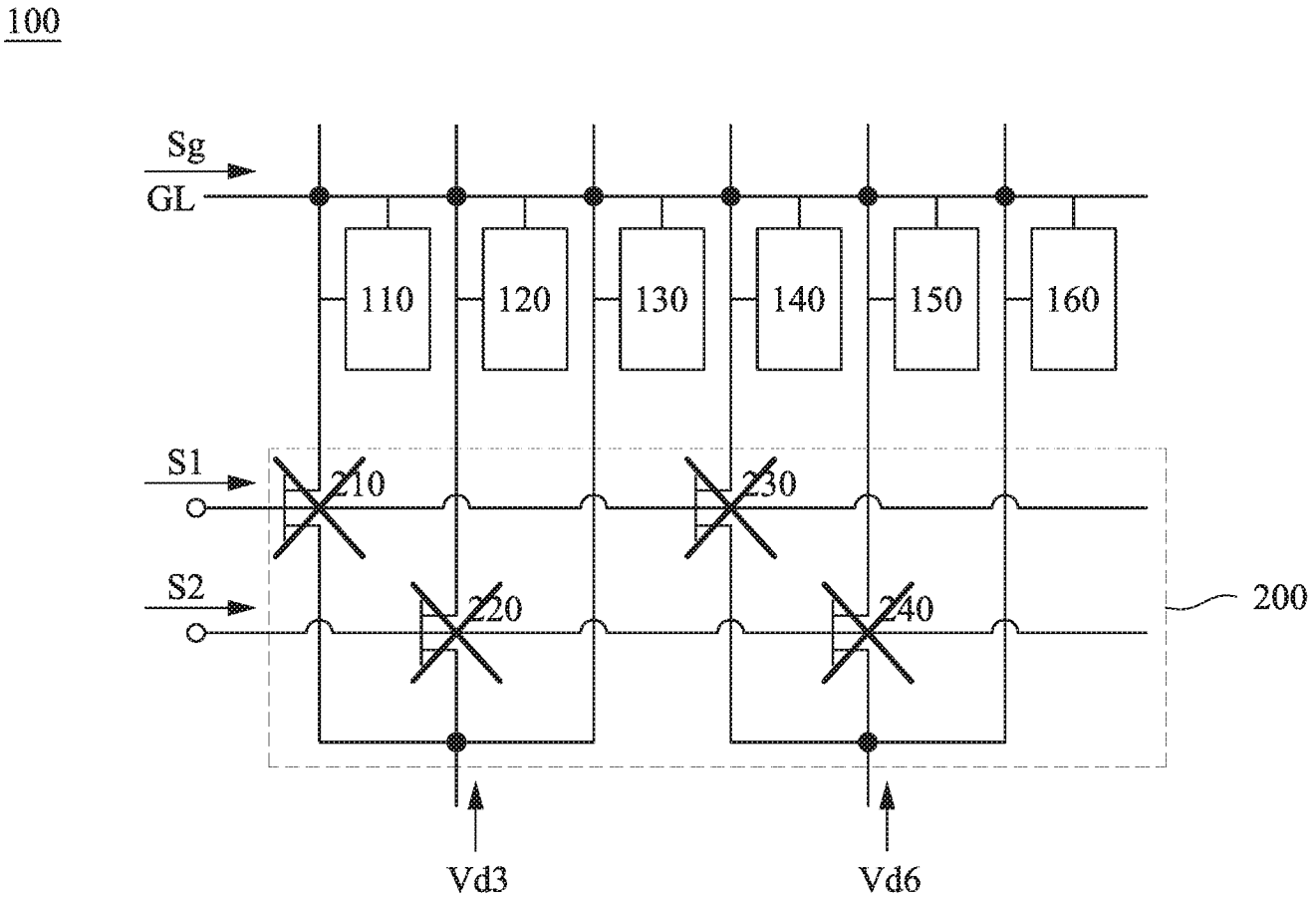

Referring to FIG. 2 and FIG. 3A-3C. FIG. 3A-3C are schematic diagrams of operational status of the multiplexer circuit 200 in some embodiments of the present disclosure. In some embodiments, as shown in FIG. 3A, the first data line DL1 has a first data voltage Vd1 and a gate line GL has a gate signal Sg in the first time duration D1. The first switch unit 210 is configured to turn on according to a first signal S1, so that the first pixel circuit 110 is charged by the first data voltage Vd1. In the first time duration D1, the second switch unit 220 is also configured to turn on according to a second signal S2, but the first data voltage Vd1 is not corresponding to the second pixel circuit 120.

As shown in FIG. 3B, in the time when the second time duration D2 does not overlap with the first time duration D1, the first data line DL1 has a second data voltage Vd2 and the gate line GL still has the gate signal Sg. At this time, the first switch unit 210 turns off but the second switch unit 220 still turns on according to the second signal S2, so that the second pixel circuit 120 is charged by the second data voltage Vd2.

In some other embodiments, The first data line DL1 has the first data voltage Vd1 in the first time duration D1. The first data line DL1 has the second data voltage Vd2 in the time duration when the second duration D2 does not overlap with the first duration D1. The first data line DL1 has a third data voltage Vd3 in the third time duration D3. Referring to FIG. 3C, the multiplexer circuit 200 is further configured to conduct the first data line DL1 and the third pixel circuit 130 in the first time duration D1, the second time duration D2 and a third time duration D3. Accordingly, in the third time duration D3, when the first data line DL1 has the third data voltage Vd3 and the gate line GL still has the gate signal Sg in a time duration D3, the first switch unit 210 and the second switch unit 220 turn off, and the third pixel circuit 130 is charged by the third data voltage Vd3.

Similarly, in some other embodiments, the multiplexer circuit 200 further includes a fourth switch unit 240 and the fifth switch unit 250, so that the fourth pixel circuit 140, the fifth pixel circuit 150 and the sixth pixel circuit 160 may be charged by the fourth data voltage Vd4, the fifth data voltage Vd5 and the sixth data voltage Vd6, respectively.

Similarly, in some other embodiments, the starting point of the first time duration D1 may be different from the starting point of the second time duration D2, but the end time point of the first time duration D1 is the same as the end point of the second time duration D2, so that the first time duration D1 and the second time duration D2 still have overlap.

When the switch unit 210-240 turns on or turns off (i.e. the rising or falling of the first signal S1 and the second S2), noise may be generated. Noise has a negative impact on the performance of the display device. Accordingly, in the case that the first time duration D1 and the second time duration D2 have overlap, since the first time duration D1 and the second time duration D2 substantially start or end at a same time, the amount of noise generation will be reduced. As shown in FIG. 2, during the enablement of the gate signal Sg, only three time points generates noise, so that the performance of the display device may be improved.

In some embodiments, the display device may eliminate the noise through a mask. The mask may maintain for about 0.5 to 2 μs (microseconds). It means, as long as the interval time between the starting points (or the end points) of the first time duration D1 and the second time duration D2 is less than the maintain time (e.g. 2 milliseconds) of the mask, the mask enables mask the noise of the first signal S1 and the second signal S2. Accordingly, as long as the interval time is less than the maintain time of the mask, it conforms to the definition of "substantially" in the above mention, because the mask enable to eliminate the noise in the maintain time.

Figure 4:
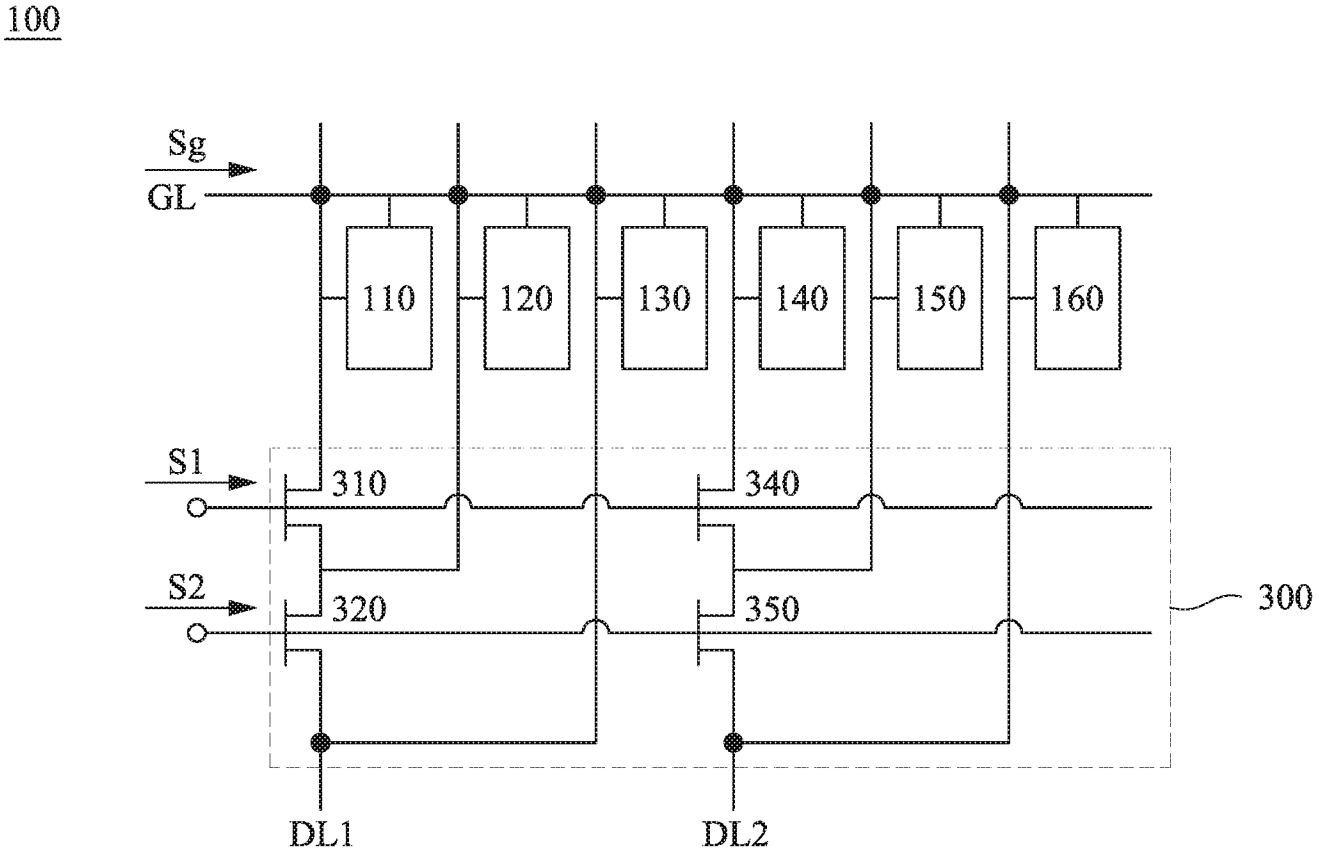
FIG. 4 is a schematic diagram of a display device in some embodiments of the present disclosure.
Figure 5:
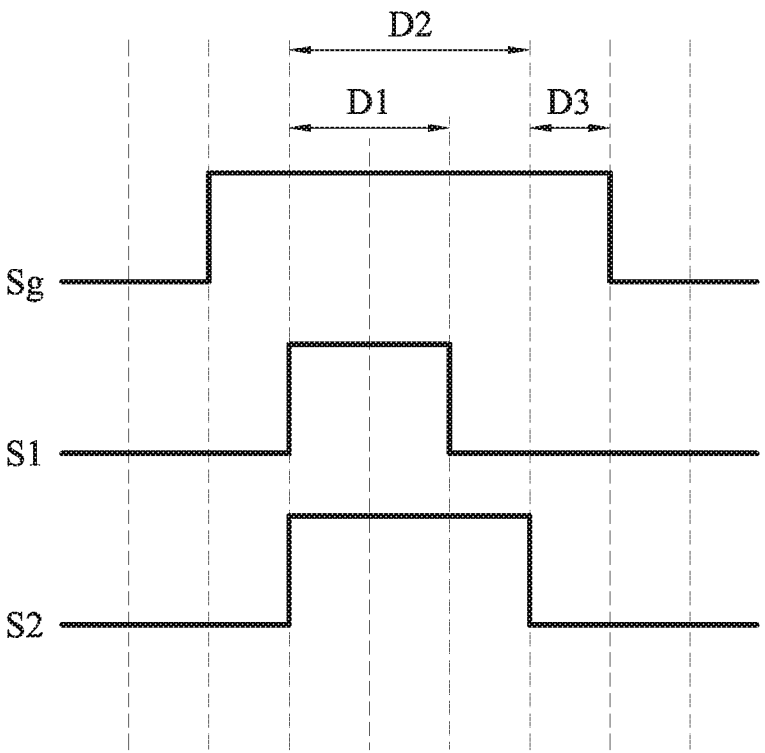
FIG. 5 is a waveform diagram of a multiplexer circuit in some embodiments of the present disclosure.

Referring to FIG. 4 and FIG. 5, wherein FIG. 4 is a schematic diagram of a multiplexer circuit 300 in some embodiments of the present disclosure, FIG. 5 is a waveform diagram of a multiplexer circuit 300 in some embodiments of the present disclosure. In FIG. 4, similar elements related to the embodiment of FIG. 1 are assigned with the same reference numerals for better understanding.

In some embodiments, the multiplexer circuit 300 includes a first switch unit 310 and a second switch unit 320. The first switch unit 310 and the second switch unit 320 are respectively configured to drive the first pixel circuit 110 and the second pixel circuit 120. The multiplexer circuit 300 further conducts the first data line DL1 to the third pixel circuit 130. Similarly, the multiplexer circuit 300 includes a fourth switch unit 340 and a fifth switch unit 350. The first data line DL1 has the first data voltage in the first time duration D1. The first data line DL1 has the second data voltage in the time duration when the second duration D2 does not overlap with the first duration D1. The first data line DL1 further has a third data voltage in the third time duration D3. One of the difference between the embodiment as shown in FIG. 4 and the foregoing embodiment as shown in FIG. 1 is that the first switch unit 310 is cascade connected to the second switch unit 220. The first switch unit 310 is electrically connected to the first data line DL1 through the second switch unit 320, so that the first pixel circuit 110 is charged when both of the first switch unit 310 and the second switch unit 320 turns on. In some embodiments shown in the FIG. 4, the multiplexer circuit 300 may be simpler than the embodiment shown in FIG. 1 due to the first switch unit 310 is cascade connected to the second switch unit 320.

In some embodiments, as shown in FIG. 4, the node between the first switch unit 310 and the second switch unit 320 is electrically connected to the second pixel circuit 120. The node between the second switch unit 320 and the first data line DL1 is electrically connected to the third pixel circuit 130. The first data line DL1 and the third pixel circuit 130 are not connected through a switch element, so that during the first time duration D1, the second time duration D2 and the third time duration D3, the first data line DL1 maintains conduction to the third pixel circuit 130.

Figure 6:
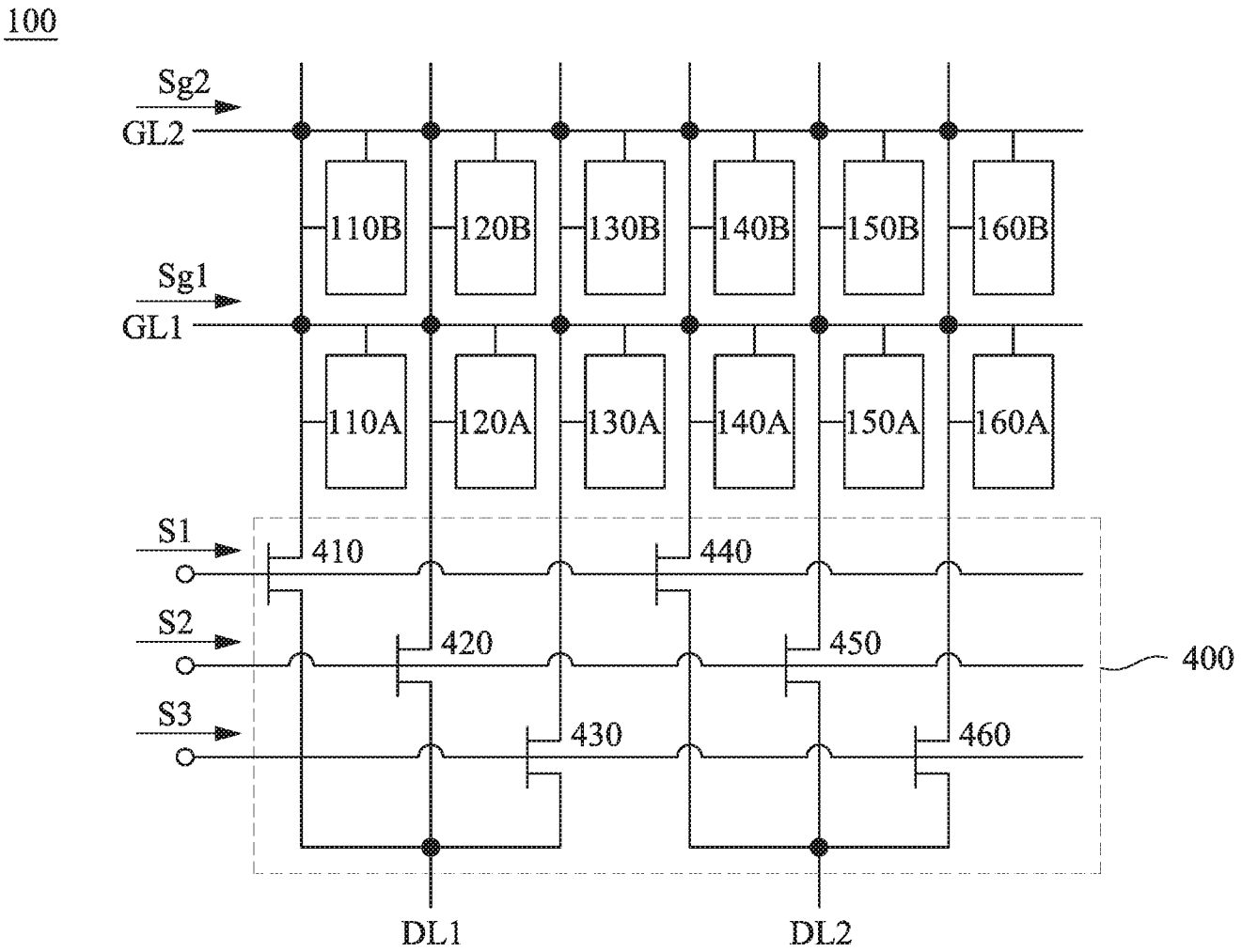
FIG. 6 is a schematic diagram of a display device in some embodiments of the present disclosure.
Figure 7:
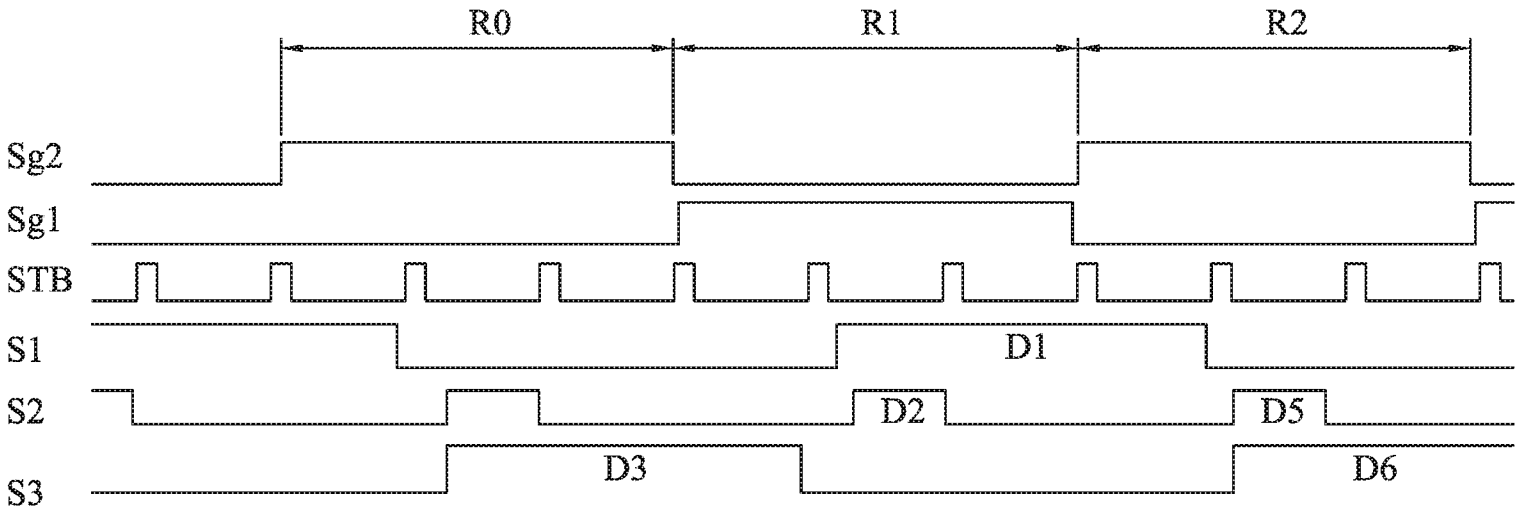
FIG. 7 is a waveform diagram of a multiplexer circuit in some embodiments of the present disclosure.

Referring to FIG. 6 and FIG. 7, wherein FIG. 6 is a schematic diagram of a multiplexer circuit 400 in some embodiments of the present disclosure, FIG. 7 is a waveform diagram of a multiplexer circuit 400 in some embodiments of the present disclosure. In FIG. 7, STB represents the clock signal in the display device. In FIG. 6, similar elements related to the embodiment of FIG. 1 are assigned with the same reference numerals for better understanding.

In some embodiments, the display device includes multiple pixel circuits 110A-160A and 110B-160B. The pixel circuits 110A-160A are corresponding to the pixels on the same row of the display device. The pixel circuits 110B-160B are corresponding to the pixels on the another same row of the display device. The first pixel circuit 110A, the second pixel circuit 120A and the third pixel circuit 130A are drived by a first data line DL1 and a first gate line GL1. The fourth pixel circuit 140A, the fifth pixel circuit 150A and the sixth pixel circuit 160A are drived by a second data line DL2 and the first gate line GL1. Similarly, the first pixel circuit 110B, the second pixel circuit 120B and the third pixel circuit 130A are drived by a first data line DL1 and a second gate line GL2. The fourth pixel circuit 140B, the fifth pixel circuit 150B and the sixth pixel circuit 160B are drived by the second data line DL2 and the second gate line GL2.

Referring to FIG. 6 and FIG. 7, in some embodiments, the display device displays pixels of different rows in multiple row periods R0, R1 and R2. In the row period R1, the first gate line GL1 transmits the first gate signal Sg1 to the pixel circuits 110A-160A after the row period R0. Then, in the row period R2, the second gate line GL2 transmits the second gate signal Sg2 to the pixel circuits 110B-160B after the row period R1.

The multiplexer circuit 400 includes a first switch unit 410, a second switch unit 420 and a third switch unit 430. The first switch unit 410 is electrically connected to a first data line DL1 and a first pixel circuit 110A, 110B. The first switch unit 410 is configured to turn on according to a first signal S1 in a first time duration D1. The second switch unit 420 is electrically connected to the first data line DL1 and a second pixel circuit 120A, 120B. The second switch unit 420 is configured to turn on according to a second signal S2 in a second time duration D2. The third switch unit 430 is configured to turn on according to a third signal S3 in a third time duration D3. In some embodiments, the first switch unit 410, the second switch unit 420 and the third switch unit 430 are connected to the first data line DL1 through the same node.

The first time duration D1 and the second time duration D2 substantially start or end at a same time, so that the first time duration D1 and the second time duration D2 have overlap. As shown in FIG. 7, the starting point of the first time duration D1 is the same as the starting point of the second time duration D2, but the end time point of the first time duration D1 is different from the end point of the second time duration D2.

In some other embodiments, the multiplexer circuit 400 further includes a fourth switch unit 440. The fourth switch unit 440 is electrically connected to the second data line DL2 and the fourth pixel circuit 140A, 140B. The fourth switch unit 440 is configured to turn on according to the first signal S1 in the first time duration D1. The first time duration D1 is corresponding to part of the row period R1 and the part of the row period R2. Accordingly, the amount of noise generation will be reduced, because the first signal S1 has only one rising and one falling in the first time duration D1.

In some embodiments, the first pixel circuit 410, the second pixel circuit 420 and the third pixel circuit 430 are charged respectively in a row period R1. The amount of the first time duration D1 is substantially same as an amount of the row period R1.

In some other embodiments, the first pixel circuit 410, the second pixel circuit 420 and the third pixel circuit 430 are charged respectively in the row period. The amount of the first time duration D1 is between 70%~130% of an amount of the row period R1. For example, the amount of the first time duration D1 is between 7.25 μs to 7.75 μs (such as 7 μs), and the amount of the maintain time of the mask is 0.5 μs to 2 μs (such as 2 μs).

In some other embodiments, the multiplexer circuit further includes a fifth switch unit 450 and a sixth switch unit 460. The fifth switch unit 250 is electrically connected to the second data line DL2 and a fifth pixel circuit 150A, 150B. The fifth switch unit 250 is configured to turn on according to the second signal S2 in a fifth time duration D5. The sixth switch unit 460 is electrically connected to the second data line DL2 and a sixth pixel circuit 160A, 160B. The sixth switch unit 460 is configured to turn on according to the third signal S3 in a sixth time duration D6. The fifth time duration D5 and the sixth time duration D6 substantially start or end at a same time, so that the fifth time duration D5 and the sixth time duration D6 have overlap.

As shown in FIG. 7, the fifth switch unit 450 and the sixth switch unit 460 are turn on after the first time duration D1. The sixth time duration D6 may extend to the next row period, and the amount of the sixth time duration D6 is substantially same as an amount of the first time duration D1, so that the signal waveform in the row period R1 may the same as the signal waveform in the next row period of the row period R2. For example, the signal waveform in the row period R0 is the same as the signal waveform in the row period R2.

In some embodiments, the switch units shown in FIG. 1, FIG. 4 and FIG. 6 can be implemented by at least one Thin Film Transistor, but the present disclosure is not limited thereto.

The elements or technical features in the foregoing embodiments may be combined with each other, and are not limited to the order of description or the order of figures presentation in the present disclosure.

It will be apparent to those skilled in the art that various modifications and variations can be made to the structure of the present disclosure without departing from the scope or spirit of the present disclosure. In view of the foregoing, it is intended that the present disclosure cover modifications and variations of this present disclosure provided they fall within the scope of the following claims.

What is claimed is:

1. A multiplexer circuit, comprising:

a first switch unit electrically connected to a first data line and a first pixel circuit, and configured to turn on according to a first signal in a first time duration;

a second switch unit electrically connected to the first data line and a second pixel circuit, and configured to turn on according to a second signal in a second time duration, wherein the first time duration and the second time duration substantially start or end at a same time, so that the first time duration and the second time duration have overlap;

a third switch unit electrically connected to the first data line and a third pixel circuit, and configured to turn on according to a third signal in a third time duration; and a fourth switch unit electrically connected to a second data line and a fourth pixel circuit, and configured to turn on according to the first signal in the first time duration;

wherein the first pixel circuit, the second pixel circuit and the third pixel circuit are charged respectively in a row period, and an amount of the first time duration is between 70%~130% of an amount of the row period.

2. A display device, comprising:

a plurality of pixel circuits;

a first data line configured to transmit a first data voltage;

a second data line configured to transmit a second data voltage; and a multiplexer circuit configured to receive the first data voltage, wherein the multiplexer circuit is configured to transmit the first data voltage to the plurality of pixel circuits according to a first signal in a first time duration, and transmit the second data voltage to the plurality of pixel circuits according to a second signal in a second time duration; the first time duration and the second time duration substantially start or end at a same time, so that the first time duration and the second time duration have overlap; wherein the multiplexer circuit comprises:

a first switch unit electrically connected to the first data line and a first pixel circuit of the plurality of pixel circuits, and configured to turn on according to the first signal in the first time duration;

a second switch unit electrically connected to the first data line and a second pixel circuit of the plurality of pixel circuits, and configured to turn on according to the second signal in the second time duration;

a third switch unit electrically connected to the first data line and a third pixel circuit of the plurality of pixel circuits, and configured to turn on according to a third signal in a third time duration; and a fourth switch unit electrically connected to the second data line and a fourth pixel circuit of the plurality of pixel circuits, and configured to turn on according to the first signal in the first time duration;

wherein the first pixel circuit, the second pixel circuit and the third pixel circuit are charged respectively in a row period, and an amount of the first time duration is between 70%~130% of an amount of the row period.

* * * * *